United States Patent [19]

Jay

[11] 4,353,532

[45] Oct. 12, 1982

[54] ALUMINUM MELTING FURNACE

[76] Inventor: Dudley W. Jay, 1051 Edgemont St., La Habra, Calif. 90631

[21] Appl. No.: 278,831

[22] Filed: Jun. 29, 1981

[51] Int. Cl.[3] ..... F27B 3/20

[52] U.S. Cl. ..... 266/242; 266/900; 266/901; 75/65 R; 75/68 R

[58] Field of Search ..... 266/200, 242, 901, 900; 75/68 R, 65 R

[56] References Cited

U.S. PATENT DOCUMENTS

| | | | |
|---|---|---|---|
| 2,020,101 | 11/1935 | Brown | 266/242 |
| 2,264,740 | 12/1941 | Brown | 266/236 |
| 2,298,055 | 10/1942 | Hulme et al. | 75/65 |
| 2,331,887 | 10/1943 | Bonsack | 266/242 |
| 2,331,992 | 10/1943 | MacDonell | 266/217 |
| 2,385,333 | 9/1945 | Clapp et al. | 266/200 |
| 2,802,656 | 4/1957 | Martiny | 266/900 |
| 2,857,642 | 10/1958 | Hess | 266/900 |
| 2,939,899 | 6/1960 | Edstrand et al. | 266/242 |
| 3,159,704 | 12/1964 | Marsteller | 266/900 |
| 3,159,704 | 12/1964 | Marsteller | 266/217 |
| 3,211,547 | 10/1965 | Jarrett et al. | 75/68 |
| 3,247,555 | 4/1966 | Keating | 266/901 |
| 3,539,169 | 11/1970 | Higgs et al. | 266/900 |
| 3,633,666 | 1/1972 | Sparks | 266/900 |
| 3,635,457 | 1/1972 | King | 75/65 R |
| 3,700,224 | 10/1972 | Nolting | 266/900 |
| 3,724,447 | 4/1973 | Parkhill et al. | 266/900 |
| 3,809,378 | 5/1974 | Iida | 266/214 |
| 4,033,564 | 7/1977 | Junghanns | 266/242 |

*Primary Examiner*—M. J. Andrews
*Attorney, Agent, or Firm*—John G. Mesaros

[57] ABSTRACT

An aluminum melting furnace apparatus of compact, thermally efficient configuration utilizing a silicon carbide plate member for covering the lower end of the combustion chamber which receives heat from a flat flame burner for uniformly heating the plate member for providing radiant heat to the melting chamber. An elongate narrow rectangular opening at one end of the combustion chamber directs flue gases under pressure toward a pre-heat hearth of a pre-heat chamber which is provided with an upwardly sloping roof with an exhaust opening at the high point thereof. The furnace is a clamshell furnace with a hinged cover having ceramic fiber insulation protected by the plate member from direct contact with molten particles of metal from the bath during melting.

12 Claims, 3 Drawing Figures

ALUMINUM MELTING FURNACE

BACKGROUND OF THE INVENTION

The background of the invention will be discussed in two parts:

1. Field of the Invention

This invention relates to aluminum melting furnaces, and more particularly to an aluminum melting furnace using radiation as the primary source of heating in the aluminum bath.

2. Description of the Prior Art

In the melting of metals in a furnace, such as in the melting of aluminum, prior art furnaces have utilized electrical resistance as a source of heat as well as petroleum or gas products. With electrical resistance heating, there are no combustion by-products, thus giving a clean melt, that is there are no impurities imparted to the bath. One such resistance heat furnace is manufactured and sold in the United States by Ajax Magnathermic Corp., of Warren, Ohio. The particular furnace is referred to as a RAM resistance furnace, and utilizes overhead resistance elements in the form of rods of silicon carbide mounted in a removable roof, the rods being connected in parallel to a source of electrical energy. The aluminum bath lies immediately below the resistance elements. However, the use of electricity as a means of heating aluminum is cost prohibitive in regions having abundant natural gas supplies for energy while lacking cheap electrical power.

A typical prior art furnace apparatus is shown and described in U.S. Pat. No. 2,264,740, issued to Brown on Dec. 2, 1941 for a Melting and Holding Furnace. In this patent, the combustion and melting chamber are one and the same with the flame from the burner directly impacting on the surface of the metal. In such prior art arrangements, dross is formed on the surface due to the reaction between the flame and the products of combustion with the metal, thus reducing the effective yield of metal.

Subsequently, melting furnaces employed arches of heat-conducting refractory such as silicon carbide, as shown in the furnace apparatus of U.S. Pat. No. 2,298,055 and U.S. Pat. No. 2,331,992, the first being issued to Hulme et al on Oct. 6, 1942 and the second being issued to MacDonell on Oct. 19, 1943. In these furnaces, referred to as muffle furnaces, the arch separates the combustion area from the melting chamber, and both employ a forward flame burner apparatus. In such furnaces, although the flame does not come in direct contact with the surface of the molten bath, the configuration results in hot spots and cold spots along the surface of the arch, thereby resulting in uneven heating of the metal. Furthermore, with a large flue opening, much of the heat escapes with the products of combustion.

In U.S. Pat. No. 3,633,665, issued to Sparks, on Jan. 11, 1972, silicon carbide is used as a floating heat conductor, in block form, for forestalling the formation of dross on the surface and for passing heat into the molten bath.

Other attempts to utilize the properties of silicon carbide in a furnace apparatus are shown and described in U.S. Pat. Nos. 3,724,447 and 3,635,457 issued to Parkhill et al on Apr. 3, 1973 and to King on Jan. 18, 1972, respectively. In both of these patents a crucible or housing of silicon carbide is immersed in the bath with the heat or flame being directed into the vessel for transfer of the heat to the bath by this contact. In the King Patent, the crucible has an open top with the result being that the products of combustion are directed over the surface of the molten bath, thus permitting the formation of oxides. With the intrusion of the crucible into the melting chamber, the volume of the melting chamber is reduced, thus requiring a larger furnace for a given volume of melt, with a correspondingly higher cost of construction. Correspondingly, with the smaller housing of Parkhill et al, for efficient heat transfer through the walls of the housing, the chamber size must be smaller. In either furnace, the crucible or housing is subjected to physical and thermal, as well as chemical abuse from the direct contact with the solid or molten metal thus requiring replacement and consequent higher operating costs and downtime.

The U.S. Pat. No. 2,385,333 issued Sept. 25, 1945 to Clapp et all illustrates an attempt to utilize the properties of silicon carbide while using the combustion gases as an additional heating source. In this furnace, a blanket in the form of a silicon carbide or similar composition tile is used. As shown, there are a series of identically configured generally rectangular dish-shaped tiles adapted to rest on the surface of the melt, or to rest on ledges, depending on the level of the bath. In addition, to provide use of the flue gas as a heat source, the flue gases circulate through ducts surrounding the melting chamber. A muffle arch is also employed as part of the apparatus, with gases from the arch passing into the ducts.

Another furnace utilizing ducts in thermal contact with the melting chamber is shown and described in U.S. Pat. No. 2,331,887 issued Oct. 19, 1943 to Bonsack. In the Bonsack furnace, forward flame burners are used with the flame being passed into tubular silicon carbide members disposed in the upper portion of the furnace interior. The flue gases communicate directly with the elaborate series of ducts or passageways encircling the melting chamber to provide radiated heat through the chamber walls.

While both of the furnaces of Bonsack and Clapp preclude direct contact between the flame and the by-products thereof, with the surface of the bath, both constructions are unduly complex, inordinately expensive to construct and subject to extensive work being required for overhauling the furnace due to the ductwork.

Accordingly, it is an object of the present invention to provide a new and improved furnace construction using a silicon carbide member as a primary source of radiant heat for melting the metal.

It is another object of the present invention to provide a new and improved furnace apparatus using a flat flame burner in conjunction with a silicon carbide plate member as a uniformly heated radiation member for melting aluminum or the like.

It is still another object of the present invention to provide a new and improved clamshell furnace having a hinged top cover utilizing ceramic fibers for insulation.

It is yet another object of the present invention to provide a new and improved, compact thermally efficient clamshell furnace for melting aluminum or the like.

SUMMARY OF THE INVENTION

The foregoing and other objects of the invention are accomplished by providing a furnace apparatus having a lower portion including a melting chamber and a pre-heat hearth lined with suitable refractory material such as silicon brick or the like, and an upper hinged top portion. The top portion, or cover is provided with a refractory brick sealing rim retaining a generally planar silicon carbide plate member in generally parallel relation to the melt line and in proximate relation thereto (with the cover closed). The cover has formed therein a combustion chamber of generally rectangular proportions, with the horizontal area of the combustion chamber generally conforming to the area of the silicon carbide plate member, which, in turn has an area closely approximating the surface area of the bath for providing uniform heat thereto. To facilitate uniformity of heating while eliminating hot and cold spots, the apparatus is provided with a flat flame burner for introducing combustion into the combustion chamber.

The pre-heat hearth is disposed adjacent the furnace door and angularly inclined relative to the bath level. The disclosed configuration provides a double chambered clamshell furnace with the chambers being the melting chamber and the pre-heat chamber. The combustion chamber is provided with an elongate rectangular opening communicating with the pre-heat chamber which has an upwardly inclined roof terminating with an exhaust opening. With a positive pressure within the combustion chamber, escaping hot flue gases are directed toward the pre-heat hearth for pre-heating ingots thereon prior to escape through the exhaust vent.

The top cover has an outer shell with ceramic fiber material being utilized to form the combustion chamber as well as the roof of the pre-heat chamber. With a hinged top cover, alloying of the molten bath is facilitated as well as cleaning of the lining, as needed. Furthermore, with the hinged top cover, relining of the melting chamber can be readily accomplished, thus reducing downtime.

Other objects, features and advantages of the furnace apparatus of the present invention will become readily apparent upon a reading of the specification, when taken in conjunction with the drawings in which like reference numerals refer to like elements in the several views.

DESCRIPTION OF THE PREFERRED EMBODIMENT

Figure 1:
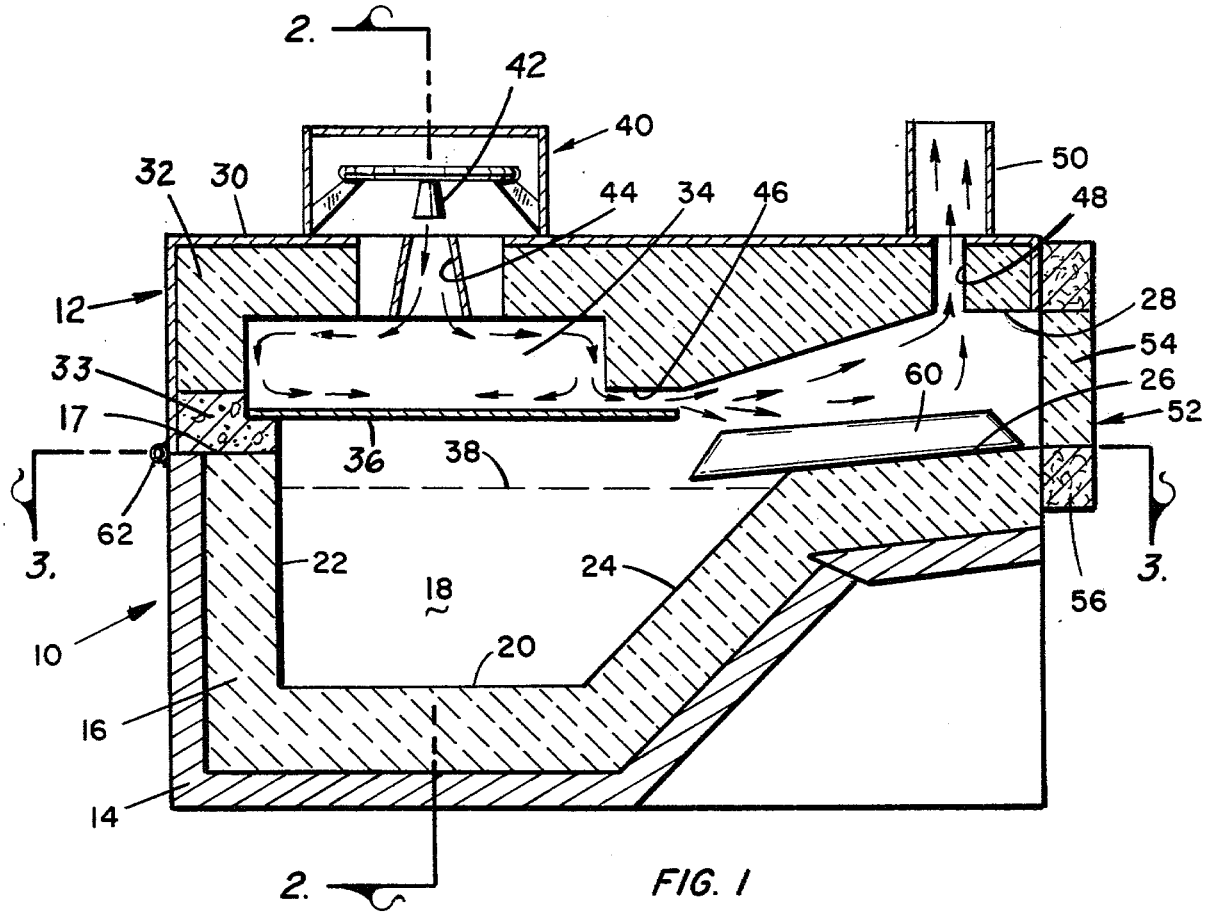
FIG. 1 is a diagrammatic side elevational view, in cross section, of a furnace apparatus according to the invention.

Referring now to the drawings, and particularly to FIG. 1, there is shown a furnace apparatus having a bottom portion, generally designated 10, and a top portion, or cover, generally designated 12. The furnace apparatus is generally box-like in form, with the bottom portion 10 having a metallic outer shell 14 with an inner lining of refractory material or brick 16 supported by a metal frame-work (not shown). The configuration of the shell 14 and the refractory brick material 16 provides an enlarged receptacle or melting chamber 18 which has a generally planar bottom or floor 20, a vertically extending rear wall 22, and a sloping front wall 24, the upper edge of which intersects a generally planar, slightly angularly upwardly disposed pre-heat hearth 26, adjacent the furnace opening 28.

The upper cover 12 is provided with a thin metallic shell 30, having an inner lining 32 formed of ceramic fiber, the lining 32 being configured for providing a combustion chamber 34 of generally rectangular configuration. The lower portion of the cover 12 is provided with a peripheral rim or ledge 33 of refractory brick for abuttingly engaging the peripheral rim 17 of the lining 16 of the lower portion (with the cover 12 closed as shown in full lines in FIG. 1).

With a clamshell furnace, weight of the top cover 12 is significant, since the lifting of the top, or pivoting thereof, by mechanical or human means, is required; and the amount of effort to be used is proportional to the weight. In prior art furnace designs, the use of ceramic fibers as a weight reduction material was difficult if not impossible, particularly in furnaces for the melting of aluminum. Splattering of molten aluminum onto the ceramic fiber surface resulted in deterioration of the fibers. This was basically caused as a result of the fiber material, which is alumina silica being contacted by aluminum oxide combined with unburned oxygen or carbon monoxide, the effect of which was to generate a chemical reaction of one oxide attempting to combine with another oxide.

On a weight basis, normally used hard fire brick weighs between 140 and 150 pounds per cubic foot, while a ceramic fiber, such as the material sold by Johns-Manville of Denver, Colo. under the trademark "Cerafelt" will have a weight of 3 to 24 pounds per cubic foot. Additionally, the insulation characteristics of this material is much better due to the lower heat storage capability. For example the heat storage capability of "Cerafelt" fiber is approximately one-quarter that of insulating fire brick and approximately one-tenth that of fireclay brick.

In accordance with the construction of the furnace apparatus of FIG. 1, the combustion chamber 34 is formed in the fiber lining 32 with a generally shallow vertical dimension, with the lower edge of the chamber 34 being generally closed by a generally planar silicon carbide plate member 36, being retained in position on the peripheral rim or ledge 33 of fire brick material. The plate member 36 is disposed (with the cover closed) in a plane generally parallel to the intended molten bath level, depicted by the dotted line 38, in spaced proximate relation thereto for providing optimum heat transfer from the radiating surface of the plate member 36 to the metal.

Figure 2:
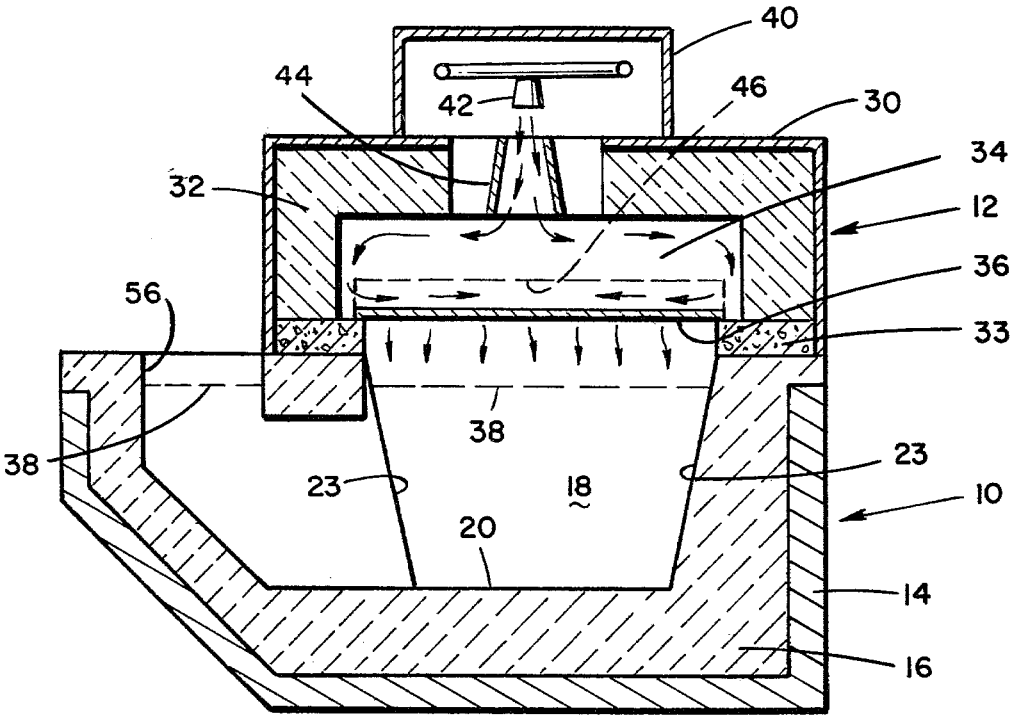
FIG. 2 is a diagrammatic cross-sectional view of the furnace apparatus of FIG. 1, taken generally along line 2—2 thereof.

Referring also to FIG. 2, it can be seen that the melting chamber 18 is provided with downwardly tapered sidewalls 23. The bath level as indicated by dotted line 38 in FIGS. 1 and 2 has a surface area which substantially conforms to the adjacent area of the plate member 36. Similarly, the horizontal area of the combustion chamber 34 closely approximates the area of the silicon carbide plate member 36.

For providing heat to the combustion chamber 34, a suitable burner apparatus, generally designated 40, is affixed to the top of the cover portion 12, with the central nozzle 42 of the burner apparatus 40 providing flame through a frustoconically formed opening 44 in the top cover 12, the opening 44 communicating with the combustion chamber 34. The burner apparatus 40 is a flat flame burner, this type of burner being configured for directing the flame into the combustion chamber 34 so that the flame "hugs" the walls of the chamber 34, as well as the inner surface of the silicon carbide plate member 36, as indicated by the arrows within the chamber 34. With this type of burner, a high degree of efficiency is achieved in transferrance of this heat from the flame to the plate member 36 for ultimate radiation into the melting chamber 18.

The end of the combustion chamber 34 adjacent to the loading end of the furnace is provided with an elongate rectangular opening 46 for permitting the escape of hot flue gases toward the pre-heat hearth 26, this area being referred to as a dry hearth chamber. The hot flue gases then travel along the under surface of the inner lining 32, which is angled upwardly toward an exhaust vent opening 48, through which the flue gases pass to a suitable exhaust duct 50.

The furnace opening 28 is formed in a top cover portion 12 and configured for being closed by a suitable door 52, the door 52 being suitably supported by the top cover portion 12 by means not shown, the door 52 having a central portion 54 of refractory material generally co-extensive with the diamension of the opening, and, an outer peripheral portion 56 formed of a solid ceramic fiber sealing material for abuttingly engaging the exterior surface surrounding the opening 28. The means for suspending the door would include a mechanisim for first enabling lateral movement of the door and then vertical movement, such means including articulated linkeges not forming a part of the present invention. By the use of the sealed door, high thermal efficiency with consequent reduction in energy use and cost are effected.

Figure 3:
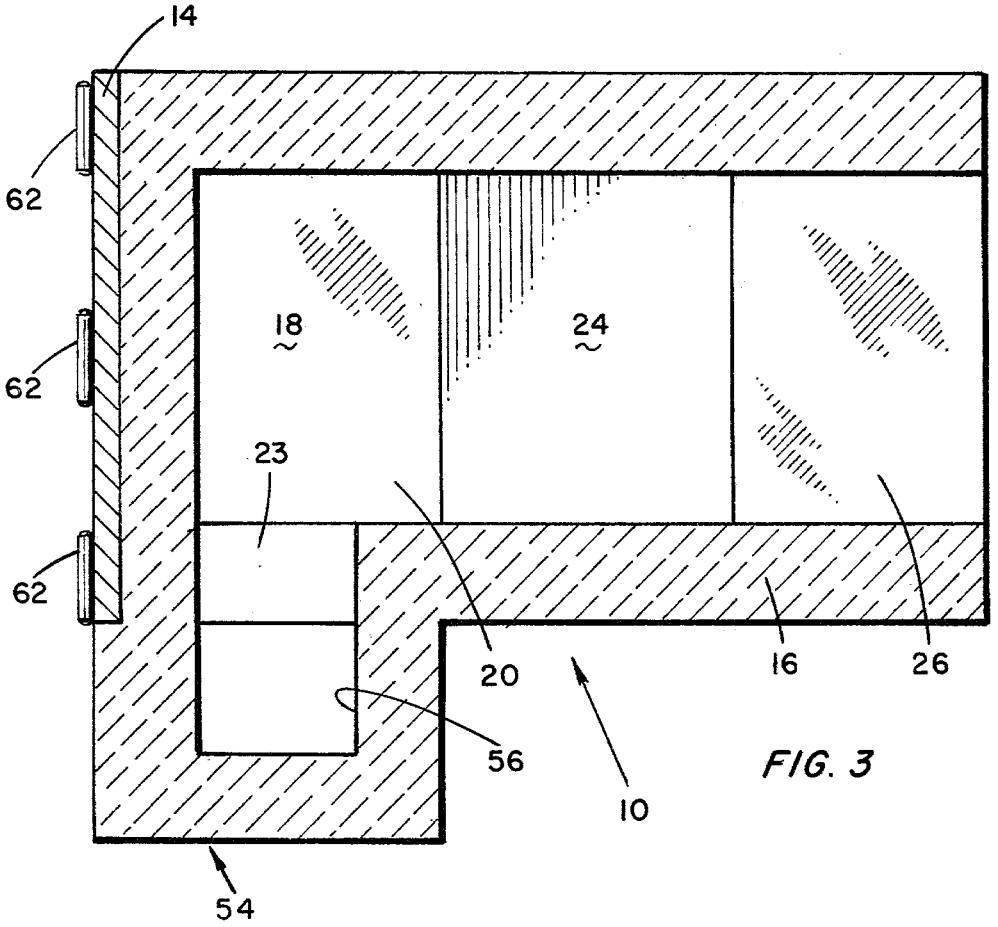
FIG. 3 is a plan view of the bottom portion of the furnace apparatus of FIG. 1, as viewed generally along line 3—3 thereof.

Referring also to FIGS. 2 and 3, the bottom portion 10 is provided with an outwardly extending section generally designated 54, this section forming an extension of the melting chamber 18 for providing access to the molten bath for removing the melt by use of a ladle or the like. This section 54 is provided with an opening 56 which extends above the bath line 38. The ladle opening 56 exposes a small surface area of the bath to the surrounding environment and, if desired, the opening 56 may be optionally covered with a second door.

The furnace of the instant invention is referred to as a double chamber clam shell furnace, the double chambers being the melt chamber 18 and the dry hearth chamber, that is the area immediately above the preheat hearth 26. The clam shell reference is to the hinged construction of the top cover 12 relative to the bottom portion 10 of the furnace. By reference to FIG. 1, the cover 12 is hinged by means of suitable hinges 62 at the rear end of the furnace (this end opposite the opening), the hinge 62 being suitably attached to the shell 14 of the lower portion 10 and to the metallic outer cover 30 of the upper cover 12. With this hinged arrangement, the upper cover 12 may be pivoted as shown in dotted lines. This hinged cover 12 assists in performing two necessary functions. If the molten metal requires alloying, the cover 12 may be pivoted to permit alloying metals to be disbursed about the surface of the bath. The hinged cover 12 likewise facilitates cleaning. After the metal has been removed from the melt chamber 18, build-ups of slag or oxides coat the walls of the chamber 18 and must be removed. The chamber 18 is readily accesible with the top cover 12 pivoted, thus facilitating cleaning.

In operation of the furnace, by reference to FIG. 1, the chamber 18 is normally charged with solid ingots similar to the ingot 60, these ingots being of the metallic composition desired as a starting point. The furnace door 52 is then closed to the position shown in FIG. 1 and heat is applied by igniting the burner apparatus 40. Flame from the nozzle 42 of the burner apparatus 40 enters the combustion chamber 34 to heat the silicon carbide member 36, with this heat then radiating downwardly to the chamber 18 to melt the metal contained therein. As the charge of metal becomes liquid in form, it acheives a certain bath level, such as indicated by dotted line 38. If it is desired to introduce additional ingots 60 into the melt, the additional ingots 60 are positioned as shown on the pre-heat hearth 26 in FIG. 1. In this position, the hot flue gases passing through the opening 46 pre-heat the ingot 60 prior to the introduction thereof into the bath. By the use of the pre-heat, a sudden temperature decrease in the bath is avoided as would be the case if the ingots 60 were introduced directly into the bath.

By the use of the top-mounted flat flame burner apparatus 40 the flame may be introduced centrally relative to the rectangularly configured combustion chamber 34 for promoting efficient heat transfer to the inner walls of the combustion chamber 34 and to the upper surface of the silicon carbide member 36. Furthermore, with the flue gas exhaust opening 46 communicating with the pre-heat chamber, efficient use of energy is acheived. In essence, the primary source of the heat for the chamber 18 is by means of radiation from the undersurface of the silicon carbide plate member 36, with the primary source of heat for the pre-heat chamber being from the flue gases. The extensive use of ceramic fiber material in the top cover portion 12 reduces the amount of weight which must be hinged while providing excellent insulation. Similarly, the use of sealing material 56 about the periphery of the door 52 provides a substantially closed interior to the furnace apparatus for retaining the heat therein.

Although prior art furnaces have heretofore employed silicon carbide members for radiating heat within a melting furnace, they have not been efficient radiating sources. Furthermore, such devices have apparently been used with forward flame burners, with the attendant inefficiencies of such devices. With forward flame burners and muffle arches or tubes, hot spots or cold spots are inherent.

In accordance with the present invention, a flat flame burner is employed in a shallowly configured combustion chamber for effectively transferring heat to a silicon carbide plate member in spaced relation to the bath line in a compact furnace configuration. Furthermore by having the radiating surface generally approximating the area of the bath, and correspondingly having the combustion chamber area closely approximating that of the radiating surface, a high degree of efficient use of heat is achieved. In addition, with the plate member 36 being so configured, it provides protection for the ceramic fiber lining 32, thus enabling the use of the fiber as a lining material for the top cover, with the attendant reduction in weight as well as volume of the cover portion 12. The only portion of the interior of the cover portion 12 which is directly exposed to the bath is the peripheral rim portion 33, which is protected by the use of fire brick material.

By reducing the weight of materials used, by use of a flat flame burner to reduce the volume of the combustion chamber 34, by use of a planar silicon carbide plate member in spaced relation to the melt line 38, a compact thermally efficient furnace has been shown and described. Furthermore, additional efficiencies are accomplished by forming the opening 46 in an elongate rectangular shape with a short vertical dimension. With this configuration, and a positive pressure in the combustion chamber 34, the exiting flue gases depart under force as a stream directed at the pre-heat hearth 26 for pre-heating ingots 60 thereon. Th upwardly inclined roof of the pre-heat chamber directs this stream of exhaust gases through the exhaust opening 48 at the highest end thereof, thereby eliminating direct contact of the flue gases with the surface of the bath 38, with a corresponding reduction in the amount of dross formed, thereby improving the yield of metal from the furnace.

While there has been shown and described a preferred embodiment, it is to be understood that various other adaptations and modifications may be made within the spirit and scope of the invention.

I claim:

1. In a furnace apparatus, the combination comprising:

a bottom housing having a melting chamber and an inclined hearth portion above the molten bath level of said melting chamber;

a top cover assembly hingedly coupled to said bottom housing, said top cover assembly including:

(a) a combustion chamber having an open bottom formed therein, said open bottom having an area parallel to the melting chamber of generally the same dimension, (b) burner means mounted on said top cover assembly for providing flame to the interior of said combustion chamber, (c) silicon carbide means substantially closing said bottom opening of said combustion chamber, said silicon carbide means being in spaced generally parallel relation to the molten bath level with said top cover assembly closed, and (d) aperture means within said combustion chamber oriented toward said hearth portion for directing flue gases thereat for preheating ingots of metal positioned thereon.

2. The combination according to claim 1 wherein said top cover assembly further includes and inclined roof portion above said hearth portion with vent means therein for permitting escape of said flue gases.

3. The combination according to claim 1 wherein said silicon carbide means is a generally planar silicon carbide plate member.

4. The combination according to claim 3 wherein said top cover assembly further includes an inclined roof portion above said hearth portion with vent means therein for permitting escape of said flue gases.

5. The combination according to claim 1 wherein said aperture means is a generally elongate narrow rectangular opening.

6. The combination according to claim 5 wherein said silicon carbide means is a generally planar silicon carbide plate member.

7. The combination according to claim 6 wherein said top cover assembly further includes an inclined roof portion above said hearth portion with vent means therein for permitting escape of said flue gases.

8. The combination according to claim 7 wherein said apparatus further includes a door opening formed in said top cover assembly adjacent said hearth portion and door means for selectively closing said door opening.

9. In a furnace apparatus for melting aluminum or the like, the combination comprising:

a bottom housing configured for providing a melting chamber and an inclined hearth portion;

refractory means lining said melting chamber and said hearth portion, said refractory means terminating in an upper generally planar peripheral edge;

a top cover assembly hingedly coupled to said bottom housing;

ceramic fiber material secured within said top cover assembly and being configured for providing a combustion chamber having an open bottom of generally the same dimension as said melting chamber, said open bottom being above said melting chamber;

an edge of refractory material secured to one of said top cover assembly and said ceramic fiber material about the lower periphery of said top cover assembly for abuttingly engaging said peripheral edge of said refractory means of said bottom housing with said top cover said top cover assembly closed;

burner means on said top cover assembly for providing flame to said combustion chamber; and silicon carbide means positioned on said edge of refractory material of said top cover assembly for generally closing said open bottom of said combustion chamber, said silicon carbide means substantially separating said combustion chamber from said melting chamber and providing radiant heating means for metal within said melting chamber with said burner means ignited.

10. The combination according to claim 9 wherein said silicon carbide means is a generally planar silicon carbide plate member in spaced proximate relation to the molten bath level of said melting chamber.

11. The combination according to claim 10 wherein said top cover assembly further includes aperture means communicating with said combustion chamber oriented toward said hearth portion for directing flue gases thereat.

12. The combination according to claim 12 wherein said ceramic material is further configured for providing an inclined roof portion above said hearth portion with vent means therein for permitting the escape of said flue gases.

* * * * *